US006668743B1

(12) United States Patent
Reynolds

(10) Patent No.: US 6,668,743 B1
(45) Date of Patent: Dec. 30, 2003

(54) SEMI-DISPLACEMENT HULL

(76) Inventor: Zachary M. Reynolds, 29 West El Rose Dr., Petaluma, CA (US) 94952

( * ) Notice: Subject to any disclaimer, the term of this patent is extended or adjusted under 35 U.S.C. 154(b) by 0 days.

(21) Appl. No.: 09/979,595

(22) PCT Filed: May 18, 2000

(86) PCT No.: PCT/US00/13927

§ 371 (c)(1),
(2), (4) Date: Mar. 4, 2002

(87) PCT Pub. No.: WO00/69715

PCT Pub. Date: Nov. 23, 2000

(51) Int. Cl.[7] ..... B63B 1/00

(52) U.S. Cl. ..... 114/61.27; 114/61.29; 114/61.3; 114/271

(58) Field of Search ..... 114/61.1, 61.2, 114/61.27–61.32, 271

(56) References Cited

U.S. PATENT DOCUMENTS 3,010,419 A 11/1961 Costa et al.
4,566,397 A * 1/1986 Cavanaugh et al. ..... 114/56
5,129,343 A 7/1992 Giles
5,191,848 A * 3/1993 Hatfield ..... 114/56
5,575,231 A * 11/1996 Metcalf ..... 114/61

* cited by examiner

*Primary Examiner*—Ed Swinehart
(74) *Attorney, Agent, or Firm*—Gray Cary Ware & Freidenrich, LLP

(57) ABSTRACT

A hull form which operates in the speed ranges where both planing and wave making affect hull resistance is presented with a configuration which reduces wave drag and improves performance in very fast and ultra-faste speed ranges. The specific distribution of immersed cross-sectional area minimizes bow wave making and optimizes the closing wake. Bow wave impedes forward motion of a hull form. Stern closing wake pushes the hull forward and enhances the forward motion. The bow sections are designed so that they have a "hollow" entrance configuration which decreases the effort to spread the water and in turn diminishes the wave making as the hull pushes through the water. The stern sections are designed to be of such a configuration that as the water spread by the bow (34) now must close in around the stern (35) of the hull, the wave height is increased so that the closing wake exerts a forward thrust on the hull.

7 Claims, 6 Drawing Sheets

SEMI-DISPLACEMENT HULL

CROSS REFERENCE TO RELATED APPLICATION

This application claims the benefit of U.S. Preliminary Patent Application Serial No. 60/134,743 filed May 18, 1999.

FIELD OF THE INVENTION

This invention relates generally to hulls for watercraft which operate in a very high and ultra high speed range where hull resistance and propulsion requirements are of primary importance and in particular to a hull form embodying a specific planing, semi-displacement configuration which reduces resistance and power requirements at these high operating speeds. More specifically, the invention relates to a vessel having a hull form, that is, a shape, a cross-section, or a contour, that both displaces the water and that causes a force to be generated to raise the vessel out of the water.

BACKGROUND OF THE INVENTION

Very high speed watercraft operate in two separate categories of hull resistance dynamics. Both categories involve potential theory concepts which relate energy input, from propulsion, to energy output from hydrodynamic pressures which create wave and pressure loads against the hull. Pressure loads create lateral wave profiles which act against the forward hull sections, which are lateral area profiles, to impede the forward motion of the hull. Pressure loads created by forward motion against the bottom surface of the hull sections act to lift the hull out of the water causing it to "plane" and thus decrease the impedance on forward motion of the hull created by the lateral wave profiles. A fully planing craft will ride completely on its bottom surface over the water surface so that the craft is lifted nearly completely out of the water and no longer behaves as an Archimedean (floating) body. In the modern design of very high speed vessels, the fully planing hull is not a realistic approach for the transport of cargo. Consequently, high speed craft involved in commercial enterprise typically operate in a speed range where wave making forces exert an important influence on hull design.

A truly viable commercial vessel operating at ultra-high speeds would be designed to take advantage of both minimal wave making and dynamic planing "lift" to decrease hull movement resistance and reduce the powering requirements of the vessel. Heretofore, wave making reduction in hull design has concentrated upon developing secondary wave systems which cancel out or reduce high bow waves or reducing wave making at specific areas of the hull rather than along the entire length of the hull. For example, increasing the stern closing wave height has not been addressed as a technique to decrease forward motion resistance. Bow appendages such as the "bulbous bow" projection have been successfully applied for full displacement, non-planing craft. These appendages are always extensions of the stem and keel, projecting ahead of the bow stem. Using bow projections as an appendage to planing craft has not proven effective since a planing craft by its nature "lifts" the hull out of the water so that the previously submerged bulbous bow projections during planing are partially out of the water and thus fail to function.

Wave drag reduction for hulls which operate at speeds where wave making and planing characteristics are combined has generally been frustrated by the complexity of the relationship between the two characteristics. Conventional approaches optimize one feature or the other, generally using horsepower to overcome the initial wave making hump at the fast speed range, where TQ=2.0, below optimal planing speeds. An approach which considers the entire immersed hull, the arrangement of immersed sectional areas over the length of the hull and the portion of the hull which can be optimized for a planing surface in conjunction with reduced wave drag has not been presented. Planing craft designed for ultra-high speed operations are typically designed to optimize the net area of the planing surface which develops the requisite "lift." As a consequence, the forward stations of a pure planing craft are full and are not designed to minimize wave making. The stern stations are as flat as possible since any wave closing augmentation is negligible as the hull is now riding nearly on the water surface due to dynamic planing "lift".

Ultra-high speed craft engaged in cargo operations, where the size of the payloads is important, must operate in displacement and immersion levels where hull configuration and wave making continue to affect performance. This relates directly to the inherently immersed configuration of the hull form where wave drag characteristics are not removed or diminished by dynamic lift (or emergence) of the hull. The hull wave drag, given the design horsepower, must not be so great as to impede the ability of the hull to reach planing speed. At high speeds where TQ=2.0, conventional hulls exhibit an increase in wave making and create a resistance "hump" which stands in the way of a typically uniform increase in the power verses speed curve. This jump in resistance can only be overcome by applying more power to the vessel, very often more power than the vessel requires for its design speed once planing speed has been achieved and the wave making "hump" has been passed.

Thus, it is desirable to provide a semi-displacement hull which reduces wave making drag and it is to this end that the present invention is directed.

SUMMARY OF THE INVENTION

A hull form which operates in the speed ranges where both planing and wave making affect hull resistance is presented with a configuration which reduces wave drag and improves performance in very fast and ultra-fast speed ranges. The hull form is constructed so that there are variations in the distribution of immersed cross-sectional area that affect wave making resistance. The specific distribution of immersed cross-sectional area minimizes bow wave making and optimizes the closing wake. The bow wave impedes forward motion of a hull form. The stern closing wake pushes the hull forward and enhances the forward motion. The bow sections are designed so that they have a "hollow" entrance configuration which decreases the effort to spread the water and in turn diminishes the wave making as the hull pushes through the water. The stem sections are designed to be of such a configuration that as the water spread by the bow now must close in around the stem of the hull, the wave height is increased so that the closing wake exerts a forward thrust on the hull. The stern wave caused by hull shape, is augmented or made higher, so that the bow sections reduce the wake height and the stern sections increase the wake height. The keel line at the bow has a slight upwards slope to allow for thinner bow sections and create hollow waterlines forward. The aft keel line has a long slope up and aft to allow for fuller and more nearly rectangular stem sections and create convex waterlines which form a slightly rounded side in the after body. Curving the afterbody section in towards the hull centerline increases the advantage of the closing thrust created by the stem wake. The sections aft of midships are all designed as low deadrise, hard chine sections where the dynamic lift surface for planing is optimized.

The semi-displacement hull in accordance with the invention significantly reduces the wave making drag of the hull at the high speed range (TQ=2.0) of vessel operation thereby allowing the vessel to reach ultra-high speeds where planing characteristics dominate hull behavior. The semi-displacement hull also includes an aft body that is developed for planing. The semi-displacement hull also may include derivative hull configurations, from a set of formulas, where hull coefficients may be varied. The invention also provides a multi-hulled high speed or ultra-high speed vessel using the semi-displacement hull.

The invention is a vessel intended for high and ultra-high speed operation and use in a semi-displacement mode where wave making and planing characteristics are present. The vessel has a semi-displacement hull with a semi-displacement forebody and an afterbody developed for planing. The hull form 1 is characterized by an immersed sectional area distribution and immersed sectional area providing a volume with concave surfaces in the forebody and convex surfaces in the afterbody. The forebody extends about 0.6 times the waterline length of the hull (0.6L) from the stem, and the afterbody extends thereafter to the stem. The stem is raked forward so that the waterlines from the stem to about 0.4 of the distance from the stem to the stem form concave contours, and the length of the bow keel slope is about one tenth the waterline length of the vessel. The bow keel has a slope less than 0.067 radians. The aft keel slopes up and aft at 0.69L from the stem and extends to the transom. The keel begins to slope up and aft 0.31L from the stem, and the elevation of the stem rise is less than 0.0266 radians.

The hull of the invention has specific parameters. For example, the average of the beam at the immersed chine and the beam at the load waterline, where B is the maximum beam at the waterline, H is the design draft, Ax is the maximum immersed cross sectional area, and B(n) is the beam at tenths of the waterline length along the waterline is given by the following:

$$B(\mathbf{2})=(0.388)(B) \text{ if } [2HB-(1.395)Ax]/B \text{ is less than H};$$

$$B(\mathbf{3})=(0.664)(B);$$

$$B(\mathbf{4})=(0.838)(B);$$

$$B(\mathbf{5})=(0.936)(B);$$

and $$B(\mathbf{6})=(0.976)(B).$$

Likewise, the immersed sectional area, An, at each one tenth of the distance from stem to stem, where n=1 through 11, and Ax is the maximum immersed cross sectional area, is given by $$A\mathbf{1}=(0.0334)Ax;$$

$$A\mathbf{2}=(0.2707)Ax;$$

$$A\mathbf{3}=(0.5735)Ax;$$

$$A\mathbf{4}=(0.7903)Ax;$$

$$A\mathbf{5}=(0.922)Ax;$$

$$A\mathbf{6}=(0.982)Ax;$$

$$A\mathbf{7}=Ax;$$

$$A\mathbf{8}=(0.982)Ax;$$

$$A\mathbf{9}=(0.891)Ax;$$

$$A\mathbf{10}=(0.701)Ax;$$

and $$A\mathbf{11}=(0.458)Ax.$$

The hull form is further characterized by the following parameters in the portion of the hull where the transition from displacement to planing occurs, that is, at approximately seven tenths of the distance from stem to stern, the hull is characterized by:

(a) an average beam B7=(0.993)(B), (b) a height of the chine, C7,=2[H(B7)−Ax]/(B7), where Ax is the maximum immersed cross sectional area;

(c) a height of the keel, K11 at the stern above a base line is K11=2(H)−C7−[(1.7058)(Ax)]/(B);

(d) the slope of the keel, RK11,=K11/[(0.31)(L)];

(e) the height of the keel, Kn, at a station, n, aft of station 7, where n=8 through 11, is Kn=[(n−1)(L/10)−(0.69)(L)](RK11); and (f) the average of the beam at the chine and the beam at the load waterline, (Bn)=2(An)/(2H−Kn−C7).

Further hull parameters include the rise of the aft keel, measured from at least about 0.69L aft from the stem to the stern, has a aft keel slope that is less than 0.0266 radians from the horizontal line of the design baseline, a deadrise from 0.7L aft of the stem to the stern that is less then 18 degrees, and a rise of the bow keel less than 0.067 radians, extending from the stem to 0.1L aft of the stem to enable a concave waterline profiles in the forward sections of the hull.

In a further embodiment of the invention, the vessel has appendages to modify area distribution and wave making and planing characteristics. Typically, the appendages are sponsons.

In a further embodiment of the invention, the vessel has multiple hulls, as a catamaran.

In this way, the invention provides an ocean-going cargo vessel capable of high speeds where a combination of low wave drag and planing lift cause a reduction in powering requirements over other conventional hull forms. The invention also provides a vessel which has a suitably large block coefficient providing sufficient cargo capacity to create suitable revenues to justify the vessel's use.

According to the invention, low hull resistance and reduced wave making are attained by a specific distribution of immersed cross-sectional areas, related to a specific design waterline draft, that creates a volume with concave surfaces in the forebody and convex surfaces in the afterbody and a specific alignment of the keel in reference to the baseline. The length of the forebody, or run of the entrance, is 0.6L from the forward point at the stem of the hull. The bottom surfaces of the hull are narrow with a high deadrise in the forebody and decrease as the entrance approaches the section of maximum cross-sectional area 0.6L from the stem and then continue on to the stern with a relatively low deadrise. The planing surfaces must be broad and relatively flat in order to optimize the lift provided by bottom pressures. This characteristic of broad, flat sections increases the wave making and is often at odds in very fast and ultra-fast hull designs. According to the invention, the wave making of the broad planing areas of the hull are used to add a forward component of thrust due to the closing wake generated by these broad planing areas.

A natural extension of hull area distribution is to use form modifiers which vary the area distribution of existing hulls to conform to the optimized distribution as proposed by this invention. For example, appendages to the side of the hull or sponson-like additions acting as form modifiers may be positioned where they are always immersed in a semi-displacement hull and operate effectively to reduce wave making.

BRIEF DESCRIPTION OR DRAWINGS

FIG. 1 illustrating a hull form in accordance with a preferred embodiment of the invention;

DETAILED DESCRIPTION OF A PREFERRED EMBODIMENT

The invention is particularly applicable to high speed or ultra high speed hulls and it is in this context that the invention will be described. It will be appreciated, however, that the hull in accordance with the invention has greater utility, such as to other vessels and crafts.

A hull form which operates in the speed ranges where both planing and wave making affect hull resistance is presented with a configuration which reduces wave drag and improves performance in very fast and ultra-fast speed ranges. The hull form is constructed so that there are variations in the distribution of immersed cross-sectional area that affect wave making resistance. The specific distribution of immersed cross-sectional area minimizes bow wave making and optimizes the closing wake. Bow wave impedes forward motion of a hull form. Stern closing wake pushes the hull forward and enhances the forward motion. The bow sections are designed so that they have a "hollow" entrance configuration which decreases the effort to spread the water and in turn diminishes the wave making as the hull pushes through the water. The stem sections are designed to be of such a configuration that as the water spread by the bow now must close in around the stem of the hull, the wave height is increased so that the closing wake exerts a forward thrust on the hull. The stein wave caused by hull shape, is augmented or made higher. So that the bow sections reduce the wake height and the stem sections increase the wake height. The keel line at the bow has a slight upwards slope to allow for thinner bow sections and create hollow waterlines forward. The aft keel line has a long slope up and aft to allow for fuller and more nearly rectangular stem sections and create convex waterlines which form a slightly rounded side in the after body. Curving the afterbody section in towards the hull centerline increases the advantage of the closing thrust created by the stem wake. The sections aft of midships are all designed as low deadrise, hard chine sections where the dynamic lift surface for planing is optimized.

Figure 1:
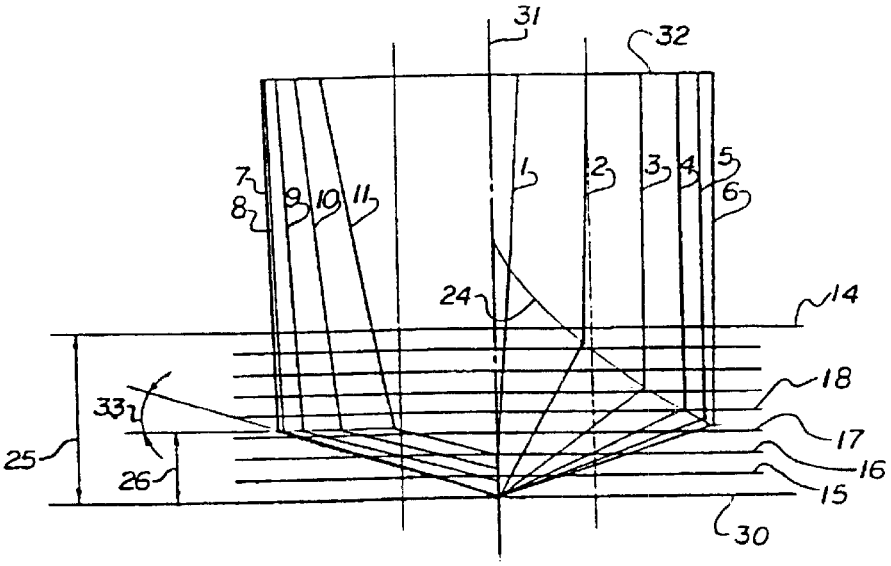

The drawing of FIG. 1 shows a body plan where transverse sections 1 through 11 are shown as outlines. Each section, 1 through 11, is represented as a contour line which runs from the centerline 31 of the hull form out to the chine 24 and then up to the deck level 32. Each hull section has a slope angle 33 from the centerline to the intersection with the chine. At each station 1 through 11, the chine 24 is a specific height 26 above the baseline 30. The vertical dimensions of the hull are measured from the baseline 30. The horizontal dimensions of the hull are measured from the centerline 31 out to a point on the outer surface of the hull station in question. All section contour lines are straight lines from the centerline to the chine. Horizontal slices 14 through 18 through the transverse sections 1–11 are referred to as "waterlines" and each represents the line of the water along the length of the hull if the hull were floating at the respective levels 14 through 18 above the baseline 30. Each waterline is located at an increment of ⅛th of the design waterline 14 height 25. Waterline 18 is located at ½ the height of the design waterline 25 above the baseline 30.

Variations in immersed sectional area distribution of the hull affect wave making resistance. The basis for this approach rests in the fundamental principals which define "linearized" velocities of an inviscid irrotational fluid, postulated by J. H Michell in 1898. Although the "thin ship" theory of Michell requires a vessel of infinitely small beam, the so called "Michell Integrals" have been applied to vessels of finite fullness, specifically by T. H. Havelock, G. P. Weinblum, and R. Guilloton. It has been demonstrated that a hull can be represented as a summation of simple geometric wedges and that pressure disturbance can be calculated for an elementary wedge using the Michell potential functions. This leads to the conclusion that an optimized hull form, which minimizes wave making, can be represented as a series of immersed areas that are elementary hull form "wedges", developed as the second differences of the station offsets. The body plan in FIG. 1 shows the contours of the sections and these contours define the area of each section. The immersed sectional areas are measured down from the design waterline, and are a measure of the complete immersed section irrespective of "design baseline" reference points. Any hull can be defined in terms of its distribution of immersed area over the entire length of the hull. In the preferred embodiment of immersed sectional area distribution, the sections 2 and 3 show a rapid increase in area compared to section 1 and 4. This distribution in area at the two points results in a hollow or concave configuration to the waterlines at these stations. The effect of this is to shift principal bow wave making aft into the region where wave pressure acting against the hull in the direction of motion is less due to the fact that station sections, at this point, present a smaller differential plane area to the wave profile and hence less lateral pressure affecting forward motion.

From the forward most position on the bow 34 (FIG. 3) of the vessel, the chine 24 has a vertical height 26 that starts out high above the baseline and diminishes to a lower height above the baseline at section 6, the midpoint of the hull. From the section 6 running aft to the section 11 the chine is a straight line at a constant height 26 above the base line 30. This configuration of the chine establishes the planing surface, as opposed to wave making forms of the hull. Locating the planing surface aft of the bow sections, which tend to create the most wave drag, ensures that the full convex forms required for effective planing surfaces do not compete with the narrow and concave sections required for reduced wave drag The design draft of the vessel 25 FIG. 1 is above the level of the chine 26 at station 6 through 11. The ratio of design draft to chine height controls the degree of concavity of the forward waterplanes. An excessive draft compared to the height of the chine will defeat the principal embodiment of the invention by creating convex waterlines forward and will alter the sectional area distribution of the immersed hull form.

Figure 2:
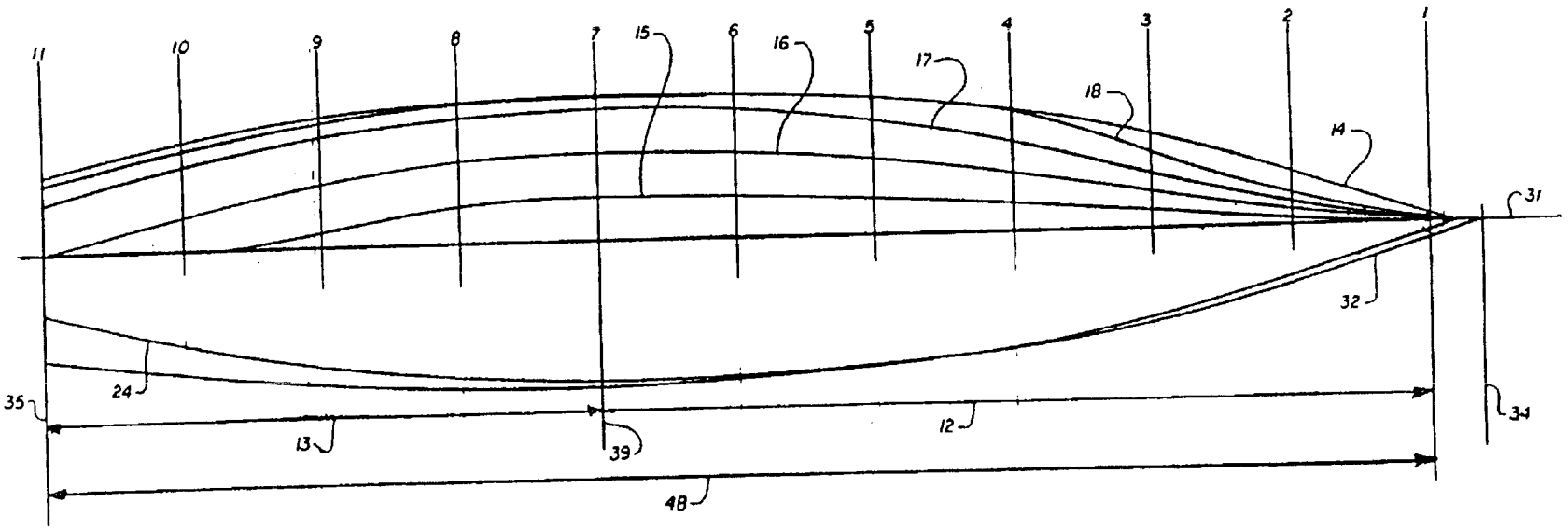
FIG. 2 is a diagram illustrating a bottom view of the hull form of FIG. 1 showing the waterlines of the hull.

A plan of the hull viewed from below looking up at the waterlines is shown in FIG. 2. The locations of the transverse sections 1 through 11 are shown. Each waterline 14 through 18 is shown as a contour where that waterline would delineate the shape of the hull running from bow 34 to stem 35 at the specific height of that waterline above the baseline 30 (FIG. 1.) The contour of the chine 24 is also shown from below looking up. The contour of the main deck 32 is shown from below looking up and extending from the forward most point 34 of the bow to the stem 35. The contour of each waterline 14 through 18 is shown from below looking up. Waterlines 15 to 18 are in the lower ⅛th division of the design waterline, where waterline 18 is one-half the height of the design waterline above the baseline 30. The entrance 12 of the hull is the length measured from the first transverse station 1 to the point of maximum sectional area 39. The length of the entrance extends from station 1 to station 7.

According to the invention, hull shape follows a specific pattern of immersed cross-section areas which minimize bow wave drag and maximize stern closing thrust. Bow stations begin thin, with low area ratio, then build to fuller areas as the stations reach midships. This creates hollow or concave waterlines in the forward bow sections of the hull. Forward stations and midships stations have larger area ratios as they build to the station of maximum immersed cross-sectional area. This creates fuller or rounded waterlines in the midbody sections of the hull. The section of maximum immersed cross-sectional area is located aft of the midpoint of the hull. After stations have full stations near the midpoint then decrease in area as the stern is approached. This creates full or concave waterlines as they close towards the stem of the vessel.

Figure 5:
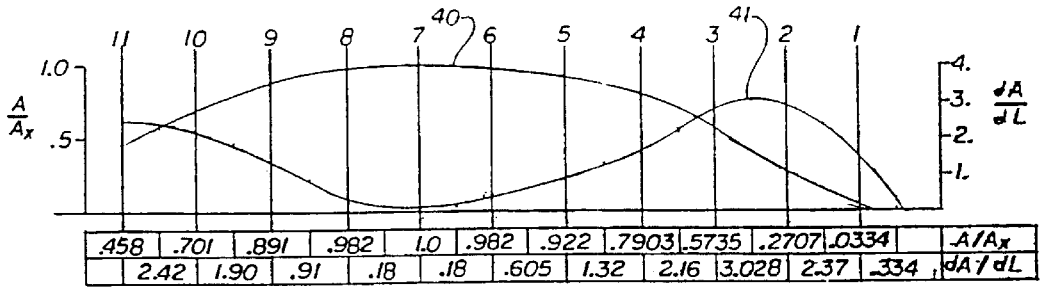
FIG. 5 is a diagram illustrating the cross-sectional areas of the immersed sections of the hull shown in FIG. 1.

It can be seen from the drawing FIG. 2 that the forward immersed stations, which form the entrance, cause the waterlines to have a definite concave characteristic. In order for this characteristic to be advantageous in diminishing wave making, according to the preferred embodiment of the invention, the immersed sectional areas must have a specific relationship as expressed in the stat curve (FIG. 5.) Aft of station 6 the chine runs at an increasingly acute angle tending to intersect the centerline 31 and diverging from the line of the main deck 32. From the forward most point of the bow 34 to the approximate tan gent point with the line of the main deck, the chine 24 is concave to the line of the main deck 32. All waterlines 15 through 18 below the load waterline 14 are concave from the forward perpendicular 1 at the bow to station 4. All waterlines 15 through 18 from station 6 to the stem 35 are convex and intersect or tend to intersect the centerline 31. The entrance chine 24 reaches its maximum offset from centerline at the point 39 of maximum immersed sectional area. The length of the entrance (Le) 12 is 60% of the length between perpendiculars (LBP) 48 FIG. 2. The aft run of the chine 24 begins at point 39 (station 7) and extends aft to the after perpendicular 11 of the stern 35 at the transom in a convex arc of diminishing offset from centerline 31. The hull form always has a transom.

The run 13 is measured from the point of maximum immersed sectional area 39 to the last transverse station 11 at the transom 35 of the hull. There is no parallel midbody or length of the hull where the immersed cross-sectional area is constant. The run begins at the point 39 where the entrance ends. It can be seen from the drawing that the afterbody stations, which form the run, cause the waterlines to have a definite convex characteristic. This characteristic is advantageous in increasing stem wave propagation, according to the preferred embodiment of the invention, when the sectional areas have a specific relationship as expressed in the dA/dL curve. The chine 24 is shown to run tangent to the line of the main deck 32 between sections 4 and 6 which indicates vertical sides between the chine and the main deck. In other versions of the invention, the line of the main deck may not be tangent to the chine at any point in the vessel's length indicating that the sides may flare out from the chine.

Figure 3:
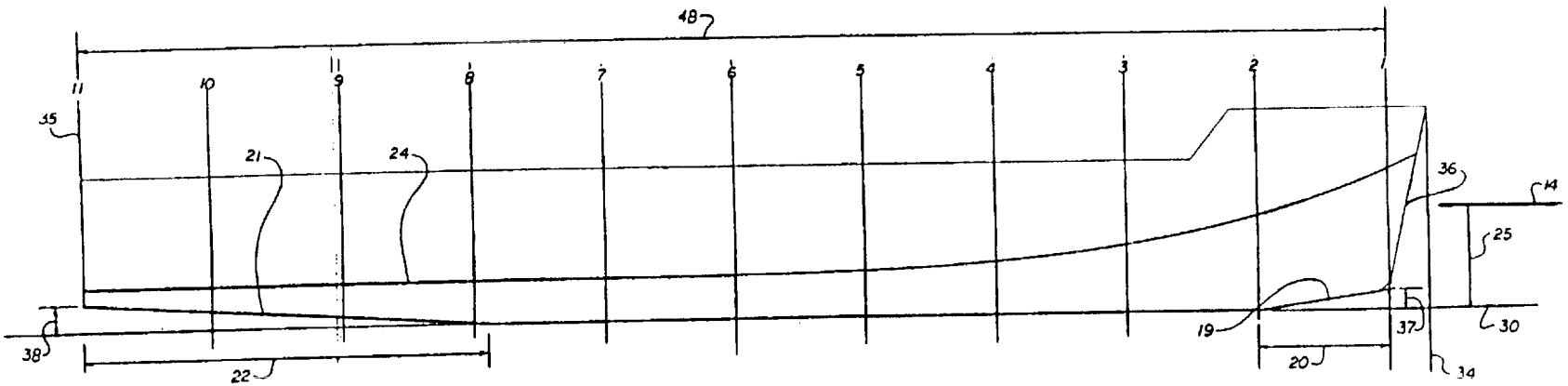
FIG. 3 is a side view of the hull shown in FIG. 1.

The profile of the hull is shown in FIG. 3. This figure shows the length between perpendiculars 48 and other basic reference points of measurement for the stations 1 through 11 and the slope of the keel forward 19 and the slope of the keel aft 21. Station 1 is located at the intersection of the bow stem 36 to the slope of the bow keel 19. Each station from station 1 is measured in equal parts so that the station spacing is 1:10th the distance from station 1 to station 11. The stem is raked forward so that waterlines 15 through 18 form concave contours between stations 1 through 4. The bow keel line is sloped up from the baseline 30 so that waterlines 15 through 18 form concave contours between stations 1 through 4. The length of the bow keel slope 20 is 0.1L, a ratio of the length from station 1 to 11. The elevation of the bow slope 37 is not greater than 0.067 radians. The aft keel 21 slopes up and aft at 0.69L 48 from station 1 and extending to the transom 35 (and station 11.) The keel begins to slope up and aft a specific distance (0.31L) 22 from the stem 35. The elevation of the stem rise 38 is not greater than 0.0266 radians. Stem rise is determined by a direct calculation which involves draft, chine height and sectional area as coefficients. The chine 24 begins high on the bow 36 and gradually slopes down to a point at station 7 where it runs to the stern 35 as a straight line parallel with the base line 30. The line of the keel follows a specific shape which is a result of hollow waterlines forward and full concave waterlines aft. The forward keel line, at the bow, rakes up towards the stem allowing immersed bow section areas to be thin and forward waterlines to be hollow. The after keel line slopes up from the midbody towards the stem. This allows the immersed stem section areas to decrease and to maintain convex waterlines as they close aft at the transom.

Figure 4:
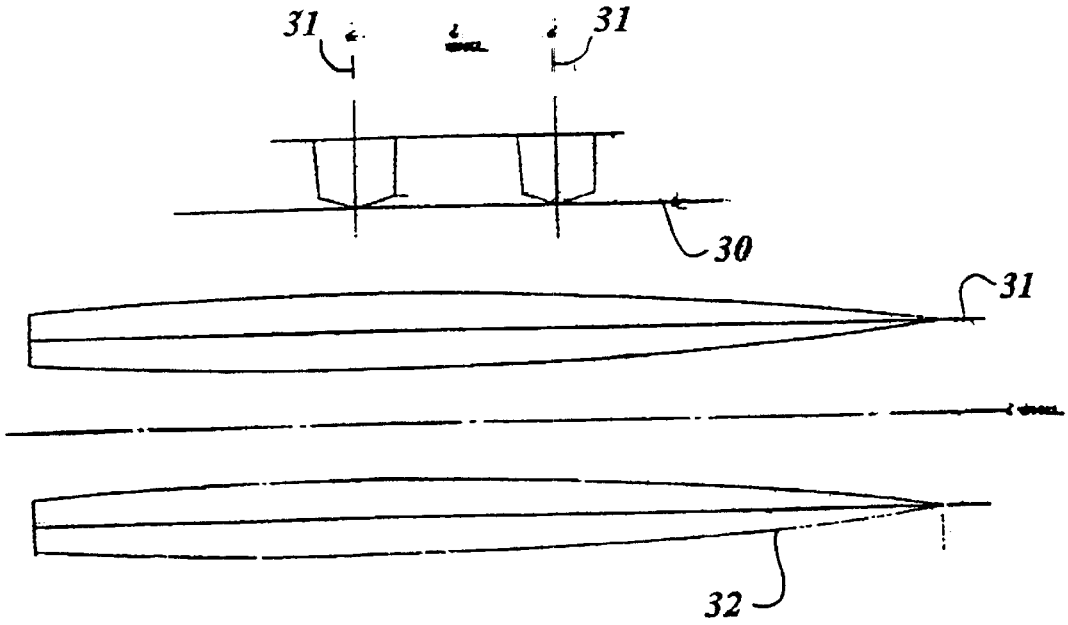
FIG. 4 is a diagram illustrating a twin hull in accordance with the invention.

A plan view of a configuration with two hulls is shown in FIG. 4. This is a twin hull arrangement that can be used as an ultra-high speed, high performance catamaran. In particular, the twin hull vessel may use the same hull form shown in FIG. 1 for each hull.

Cross-sectional areas 40 of the immersed sections of the stations 1 through 11, shown in FIG. 5, have a specific relationship to each other. The relationship can be expressed in terms of a curve which shows the rate of change of the immersed section area at a given station per unit change in length. Numerically this is the change in the immersed section area, expressed as a percentage of the immersed area at the maximum section, for one percent change in length. These values (dA/dL) are shown graphically as a curve 41 plotted over the length of the vessel. The large dA/dL values in the first three stations 1 through 3 characterize the hollow waterlines 14 through 17 that are shown on FIG. 2. As the hull shape becomes fuller at the midbody, the dA/dL curve diminishes and reaches its lowest value at station 7 just aft of the midbody As the aft stations begin to diminish in immersed sectional area from the maximum at station 7, the dA/dL curve begins to rise. In association with the rising keel line, this causes the afterbody stations to be convex to the line of the main deck and is characteristic of the waterlines which slope in towards the hull centerline, as seen in FIG. 2.

The immersed sections of a hull form, which corresponds to the preferred embodiment of the invention, are determined, using the immersed sectional area distribution 40 FIG. 5, by applying specific formulae to predetermined variables. The predetermined variables are a result of decisions made by the hull designer and include length (L), maximum beam at the waterline (B), desired draft (H), load displacement and block coefficient (Cb). The prismatic coefficient (Cp) of the preferred embodiment of the invention is 0.735. Other prismatic coefficients may be chosen.

The block coefficient Cb is determined by dividing the displaced volume of the hull by the block cubic of the chosen hull dimensions:

$$Cb=(\text{actual Volume})/(L\times B\times H)$$

Where the actual volume, for salt water, is the chosen load displacement (in long tons, 2240 lbs) times 35.18 cu ft per ton.

The midships area coefficient, Cx, is determined, where:

$$Cx=Cb/Cp$$

The maximum immersed cross sectional area, Ax, at station 7 is determined as:

$$Ax=Cx(H)(B)=A7$$

Each immersed sectional area for each station 1 through 11 is then determined by referencing FIG. 5 and obtaining the sectional area ratio (An/Ax) for each section (An) where n=1 to 11.

For the dimensions of the bow stations 1 to 6

The height, K1, of the keel above the base line at station 1 is:

$$K1=(0.061)(0.1L)$$

In the preferred embodiment of the invention, the height of the chine at station 1 is above the design draft 25 in FIG. 1, of the vessel, so that the immersed bow section of station 1 is a simple triangle and the beam, Bd1, of station 1 at the design draft (H) 14 shown in FIG. 1 is:

$$Bd1=[(0.0668)(Ax)]/(H-K1)$$

In the preferred embodiment of the invention, if the relationship of:

$$[2HB-(1.395)Ax]/B \text{ is larger than the design draft H,}$$

then the chine at station 2 is above the design draft 25 FIG. 1, of the vessel so that the immersed bow section of station 2 is a simple triangle and the beam Bd2 of station 2 at the design draft (H) is:

$$Bd2=[(0.5414)(Ax)]/H$$

The corresponding average of the beam at the immersed chine and the beam at the load waterline is designated as (Bn). At stations 2 through 6 (Bn) is calculated as:

$$B2=(0.388)(B) \text{ if the relationship } [2HB-(1.395)Ax]/B \text{ is less than H}$$

$$B3=(0.664)(B)$$

$$B4=(0.838)(B)$$

$$B5=(0.936)(B)$$

$$B6=(0.976)(B)$$

The immersed sectional area, An, at each station where n=1 through 11 is:

$$A1=(0.0334)Ax$$

$$A2=(0.2707)Ax$$

$$A3=(0.5735)Ax$$

$$A4=(0.7903)Ax$$

$$A5\ 32\ (0.922)Ax$$

$$A6=(0.982)Ax$$

$$A7=Ax$$

$$A8=(0.982)Ax$$

$$A9=(0.891)Ax$$

$$A10=(0.701)Ax$$

$$A11=(0.458)Ax$$

The height of the immersed chine, Cn, at each station n=2 through 6 is $$Cn=2[H(Bn)-An]/Bn$$

C2 is only calculated if the chine at station 2 is immersed.

For the Dimensions of the after Stations 7 to 11

The average beam, B7, at station 7 is calculated as:

$$B7=(0.993)(B)$$

The height of the chine, C7, at station 7 is determined as:

$$\text{i } C7=2[H(B7)-Ax]/(B7)$$

The height of the keel (K11) 38 of FIG. 3 at the stem 35 above the base line 30 is calculated as:

$$K11=2(H)-C7-[(1.7058)(Ax)]/(B)$$

The slope of the keel aft (RK11) is:

$$RK11=K11/[(0.31)(L)]$$

The height of the keel, Kn, at any station (n) aft of station 7, where n=8 through 11, is $$Kn=[(n-1)(L/10)-(0.69)(L)](RK11)$$

The average of the beam at the chine and the beam at the load waterline is designated as (Bn). At stations 8 through 11 (Bn) is calculated as:

$$Bn=2(An)/(2H-Kn-C7)$$

The points developed by the formulas given above may require slight adjustments to satisfy the requirements of a "fair" set of lines which describe the hull shape of the invention.

Figure 6:
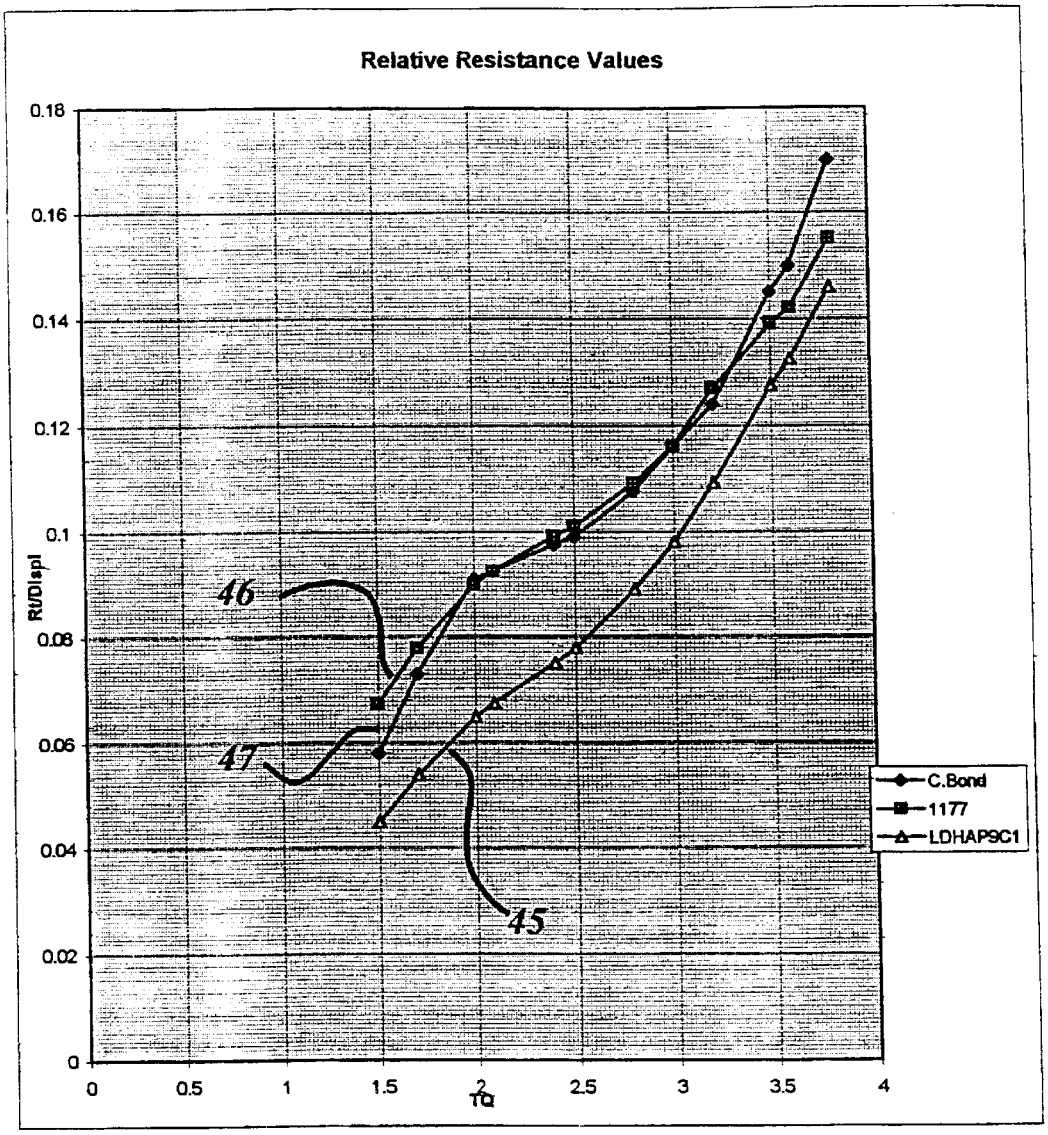
FIG. 6 is a chart illustrating the wave making drag of the hull shown in FIG. 1 as compared to the conventional hulls.

Hull resistance 45 of the invention can be shown to have significantly less wave making drag compared to published test results of conventional hulls 46 & 47 throughout the operational speeds of the invention, as shown in FIG. 6. Using non-dimensional coefficients, the resistance coefficient of the hull (total resistance divided by displacement or Rt/Displ) can be plotted against the speed coefficient TQ (vessel speed in knots divided by square root of vessel length or Taylor Quotient.) The hull form operates both as a planing hull and a displacement hull where wave making is significant. Operating at speeds where planing is the dominant hull behavior, the wave making becomes minimal and the hull resistance is principally a function of dynamic lift on the bottom surface of the hull. These planing speeds are reached at a TQ above 2.5. At speeds below a TQ of 2.5 a combination of planing and wave making takes place. The wave making resistance can be so great as to form a "hump" right at the mid-range of hull speed before the hull reaches its planing speed. This resistance hump, shown at a TQ of 2.0 for the conventional hulls 46 & 47, can be large enough to require extra propulsive power just to overcome the mid-range resistance, power which is not required in the planing speeds.

While the foregoing has been with reference to a particular embodiment of the invention, it will be appreciated by those skilled in the art that changes in this embodiment may be made without departing from the principles and spirit of the invention, the scope of which is defined by the appended claims.

I claim:

1. A vessel intended for high and ultra-high speed operation and use in a semi-displacement mode where wave making and planing characteristics are present, the vessel having a semi-displacement hull having a semi-displacement forebody and an afterbody developed for planing;

wherein the hull is characterized by an immersed sectional area distribution and immersed sectional area providing a volume with concave surfaces in the forebody and convex surfaces in the afterbody, and has a forebody extending about 0.6 times the waterline length of the hull from the stem, and an afterbody thereafter to the stern;

wherein the stem is raked forward the waterlines from the stem to about 0.4 of the distance from the stem to the stern to form concave contours;

wherein the length of the bow keel slope is about one tenth the waterline length of the vessel; and wherein the bow has a slope less than 0.067 radians.

2. A vessel intended for high and ultra-high speed operation and use in a semi-displacement mode where wave making and planing characteristics are present, the vessel having a semi-displacement hull having a semi-displacement forebody and an afterbody developed for planing;

wherein the hull is characterized by an immersed sectional area distribution and immersed sectional area providing a volume with concave surfaces in the forebody and convex surfaces in the afterbody; and wherein the average of the beam at the immersed chine and the beam at the load waterline, where B is the maximum beam at the waterline, H is the design draft, Ax is the maximum immersed cross sectional area, and B(n) is the beam at tenths of the waterline length along the waterline as follows:

$$B(\mathbf{2})=(0.388)(B) \text{ if } [2HB-(1.395)Ax]/B \text{ is less than H};$$

$$B(\mathbf{3})=(0.664)(B);$$

$$B(\mathbf{4})=(0.838)(B);$$

$$B(\mathbf{5})=(0.936)(B);$$

and $$B(\mathbf{6})=(0.976)(B).$$

3. A vessel intended for high and ultra-high speed operation and use in a semi-displacement mode where wave making and planing characteristics are present, the vessel having a semi-displacement hull having a semi-displacement forebody and an afterbody developed for planing, wherein the hull is characterized by an immersed sectional area distribution and immersed sectional area providing a volume with concave surfaces in the forebody and convex surfaces in the afterbody; and wherein the height of the chine at station 1 is above the design draft, the immersed bow section of station 1 is a simple triangle, and the beam, Bd1, of station 1 at the design draft, H, where Ax is the maximum immersed cross sectional area, and K1 is the height of the keel above the base line at station 1, is:

$$Bd\mathbf{1}=[(0.0668)(Ax)]/(H-K\mathbf{1}).$$

4. A vessel intended for high and ultra-high speed operation and use in a semi-displacement mode where wave making and planing characteristics are present, the vessel having a semi-displacement hull having a semi-displacement forebody and an afterbody developed for planing;

wherein the hull is characterized by an immersed sectional area distribution and immersed sectional area providing a volume with concave surfaces in the forebody and convex surfaces in the afterbody; and wherein [2HB−(1.395)Ax]/B is larger then the design draft H, the immersed bow section of station 1 is a simple triangle, and the beam, Bd2, of station 2 at the design draft, H, where Ax is the maximum immersed cross sectional area, is $$Bd\mathbf{2}=[(0.5414)(Ax)\}/H.$$

5. A vessel intended for high and ultra-high speed operation and use in a semi-displacement mode where wave making and planing characteristics are present, the vessel having a semi-displacement hull having a semi-displacement forebody and an afterbody developed for planing;

wherein the hull is characterized by an immersed sectional area distribution and immersed sectional area providing a volume with concave surfaces in the forebody and convex surfaces in the afterbody; and wherein the immersed sectional area, An, at each one tenth of the distance from stem to stern, where n=1 through 11, and Ax is the maximum immersed cross sectional area, is:

$$A\mathbf{1}=(0.0334)Ax;$$

$$A\mathbf{2}=(0.2707)Ax;$$

$$A\mathbf{3}=(0.5735)Ax;$$

$$A\mathbf{4}=(0.7903)Ax;$$

$$A\mathbf{5}=(0.922)Ax;$$

$$A\mathbf{6}=(0.982)Ax;$$

$$A\mathbf{7}=Ax;$$

$$A\mathbf{8}=(0.982)Ax;$$

$$A\mathbf{9}=(0.891)Ax;$$

$$A\mathbf{10}=(0.701)Ax;$$

and $$A\mathbf{11}=(0.458)Ax.$$

6. A vessel intended for high and ultra-high speed operation and use in a semi-displacement mode where wave making and planing characteristics are present, the vessel having a semi-displacement hull having a semi-displacement forebody and an afterbody developed for planing;

wherein the hull is characterized by an immersed sectional area distribution and immersed sectional area providing a volume with concave surfaces in the forebody and convex surfaces in the afterbody; and wherein, approximately seven tenths of the distance from stem to stern, the hull is characterized by:

(a) an average beam B7=(0.993)(B);

(b) a height of the chine, C7,=2[H(B7)−Ax]/(B7), where Ax is the maximum immersed cross sectional area;

(c) a height of the keel, K11 at the stern above a base line is K11=2(H)−C7−[(1.7058)(Ax)]/(B);

(d) the slope of the keel, RK11,=K11/[(0.31)(L)];

(e) the height of the keel, Kn, at a station, n, aft of station 7, where n=8 through 11, is Kn=[(n−1)(L/10)−(0.69)(L)](RK11); and (f) the average of the beam at the chine and the beam at the load waterline, (Bn)=2(An)/(2H−Kn−C7).

7. A vessel intended for high and ultra-high speed operation and use in a semi-displacement mode where wave making and planing characteristics are present, the vessel having a semi-displacement hull having a semi-displacement forebody and an afterbody developed for planing;

wherein the hull is characterized by an immersed sectional area distribution and immersed sectional area providing a volume with concave surfaces in the forebody and convex surfaces in the afterbody; and further comprising a rise of the bow keel less than 0.067 radians, extending from the stem to 0.1L aft of the stem to enable concave waterline profiles in the forward sections of the hull.

* * * * *